US005863634A

United States Patent [19]

Caballero Rodriguez et al.

[11] Patent Number: 5,863,634

[45] Date of Patent: Jan. 26, 1999

[54] COMPOUND THREADS, FABRICS PROVIDED THEREFROM AND PROCESS TO OBTAIN THEM

[75] Inventors: Antonio Caballero Rodriguez; Leopoldo Marti Andres, both of Barcelona, Spain

[73] Assignee: TT 1U, S.L., Barcelona, Spain

[21] Appl. No.: 788,278

[22] Filed: Jan. 24, 1997

Related U.S. Application Data

[62] Division of Ser. No. 259,174, Jun. 10, 1994, Pat. No. 5,622,766.

[30] Foreign Application Priority Data

Jun. 17, 1993 [ES] Spain ..... 9301348
Jun. 17, 1993 [ES] Spain ..... 9301349

[51] Int. Cl.[6] ..... B32B 5/12

[52] U.S. Cl. ..... 428/110; 428/109; 442/1; 442/35; 442/203

[58] Field of Search ..... 442/189, 203, 442/2, 3, 4, 5, 6, 35, 1; 139/383 R; 428/110, 109

[56] References Cited

U.S. PATENT DOCUMENTS

| | | | |
|---|---|---|---|
| 2,902,395 | 9/1959 | Hirschy et al. . | |
| 2,942,327 | 6/1960 | Corry | 442/203 |
| 3,835,638 | 9/1974 | Mayer et al. . | |
| 3,957,091 | 5/1976 | Buyssens et al. | 442/6 |
| 4,623,281 | 11/1986 | Verbanwhede et al. | 442/6 |
| 5,219,633 | 6/1993 | Sabee . | |
| 5,447,787 | 9/1995 | Shaffer | 442/2 |

FOREIGN PATENT DOCUMENTS

| | | |
|---|---|---|
| A-0 339 965 | 11/1989 | European Pat. Off. . |
| A-28 39 941 | 3/1980 | Germany . |
| A-61 296 134 | 12/1986 | Japan . |
| A-02 289 137 | 11/1990 | Japan . |
| A-4-66162 | 3/1992 | Japan . |
| WO 80/01171 | 6/1980 | WIPO . |

*Primary Examiner*—James J. Bell
*Attorney, Agent, or Firm*—Darby & Darby

[57] ABSTRACT

Compound threads (1) and the fabrics obtained therefrom are very inexpensive, of acceptable quality and preferably useable to make recyclable disposable garments. Said threads (1) include a thin carrier thread (2) to which a web mass (3) coming from the carding of the fiber used, is adhered preferably by means of use of a water-soluble glue or electrostatic means.

The compound thread (1) has the possibility of making use, upon making the web (3), of the shortest fibrils that are usually disposed of.

One of the fabrics obtained consists of a band or strip of web (3) that includes several carrier threads (2) placed parallel to each other and that can be cut to obtain compound threads (1.)

Another fabric consists of weft thread and crossed warp thread of which all or some, depending on the different combinations, are compound threads (1.)

14 Claims, 2 Drawing Sheets

COMPOUND THREADS, FABRICS PROVIDED THEREFROM AND PROCESS TO OBTAIN THEM

This is a division of application Ser. No. 8/259,174, filed Jun. 10, 1994 now U.S. Pat. No. 5,622,766.

OBJECT OF THE INVENTION

The present invention refers to some compound threads, to the fabrics provided therefrom and to the processes to obtain said threads and fabrics.

One of the purposes of the invention is to obtain a very inexpensive, acceptable quality thread preferably for use in disposable fabrics, without eliminating other possible uses.

Another purpose consists of making use of the short fibers of the carded material from which the threads are made, fibers which are disposed of in normal processes differing from the invention as no usefulness is found for them.

Another purpose consists of obtaining a fabric in the form of a strip or band, from whose cutting compound threads according to the invention can be obtained.

It also has the purpose of providing a disposable recyclable fabric whose duration, as well as its applications, are similar to those of a conventional textile fabric between washing and washing.

Another purpose, implicit in the above, is that obtainment of the disposable fabric is as inexpensive as possible, so that the frequent purchase thereof does not imply excess expenses for the user and so that the marketing thereof is feasible.

The main use of these disposable fabrics is in hospitals, barracks, schools and similar places where massive use of bed and table linens implies problems and excessive cleaning, maintenance, sterilization and repair costs; as well as time lost in carrying out such tasks. Nonetheless, the disposable fabrics of the invention can be useful to any type of establishment or person and for other purposes (such as for examples, rags for cleaning dust cloths, paper pulp, etc.) that are considered convenient.

BACKGROUND OF THE INVENTION

The process to make conventional threads in which one starts with the web of the fiber to be used obtained by carding, so that initially a carding cord is obtained which is the base from which the twisted and stretched thread is obtained, is known. The fiber of said cord must have long hair so that upon twisting it and stretching it, it does not break. This implies the inconveniences that all the very short fibers of the material that is used are not made use of, and that the thread obtained is too expensive, especially if disposable fabrics are to be made therefrom.

On the other hand, unwoven disposable elements that replace traditional textile pieces such as napkins, table cloths, paper tissues, etc. are known. Said unwoven elements are comprised of an accumulation of layers of cellulose with different finenesses with specific properties of absorption, resistance and other features. These cellulose layers are joined by means of acrylic chemical products or the like. The cited unwoven elements have certain inconveniences, such as their resistance and consistency drop upon becoming wet becoming unuseable for the most part, or their touch differs greatly from that of textile pieces which they replace, or they cause allergies in users.

Low cost fabric elements whose cost reduction is determined by the reduction of the number of weft thread per centimeter are known. Said fabrics manufactured at a low cost have the inconvenience that they have few threads per unit of length and between said threads big holes that reduce the continuity of the obtained fabric, making it unacceptable for many uses for which its use would be desirable, are established.

Concerning compound threads the following documents have been found in the corresponding search:

European patent application EP-A-0339965

U.S. patent application U.S. Pat. No. 3,835,638

German patent application DE-A-28 39 941

Abstract of Japanese patent application JP-A-022891376

Abstract of Japanese patent application JP-A-61296134.

The document EP-A-0339965 refers to a bushy thread that is comprised of a core thread with a total denier of 140 to 1,260, an adhesive that is applied to the core or carrier thread, as well as bushy fibers (flies of fibers) with a cutting length of 0.5 to 3 mm which is intermatted to an intermatting density of no less than 30,000/cm$^2$. Said thread is obtained by means of a process in which the intermatted fibers are applied by means of an adhesive layer to the core thread. Electrostatic fields in which forces of attraction and forces of repulsion alternately are also applied, changing the polarity of some pairs of electrodes or placing electrostatic fields of attraction and repulsion sequentially.

The document U.S. Pat. No. 3,835,638 refers to a process for continuous forming of different types of carrier threads. Said process basically comprises an electrostatic coating of the periphery of a center element with individual fibers. The individual fibers are expelled through a duct towards an electric field generated by a suitable unit. Besides, a tank which, according to this document, contains a reticulating agent, is included, so that the original center element passes through the tank.

The document DE-A-28 39 941 refers to a device for an electrostatic process of textile fiber projection, which permits bushy thread to be manufactured. Said device basically comprises a projection or piling chamber, through which a carrier thread passes, whose top and bottom are provided with respective electrodes, and that has an endless conveyor belt comprised of fiber glass for the supply of bushy material, including a transport organ positioned in a plane inferior to the top electrode and moveable with regard to a device for eliminating bushy material by means of which the bushy material adhered to the cited transport organ is eliminated. As indicated in this document, the purpose of the device is to prevent that in the top chambers of the apparatus that are used in electrostatic textile fiber projection processes for manufacturing bushy thread, irregular accumulations of bushy fibers are produced in the top electrodes of the projection chambers, as well as to prevent, even when there is a small accumulation, uncontrolled variations of the electric-camp from being produced. On the other hand, this document cites as prior art devices for electrostatic textile fiber projection, in whose projection chambers the bushy material is applied on the carrier thread provided with an adhesive agent.

The document JP-A-022891376 refers to a bushy product with an ion exchange capacity and to the manufacturing process thereof. The product is obtained by means of a process that consists of introducing a core or carrier thread with a total denier of 50 to 50,000 whose periphery is coated with an adhesive, in an area in which there is at least one pair of electrodes of which to one of them a positive voltage is applied and to the other one a negative voltage is applied, intermittently changing the polarity of said electrodes to generate an electrostatic field in which forces of attraction or forces of repulsion act alternately. During the process pulp that is prepared by cutting a fibrous material with an ion exchange capacity at a length of 0.1 to 3 mm is applied to the adhesive layer of the carrier thread.

Japanese patent application JP-A-61296134 refers to a compound thread of a mixture of cotton and feathers that is obtained by adding to the feathers a water-soluble adhesive agent, or a hydrophilous organic solvent, to obtain feather fibers with a volumen ratio of less than 100 cc/g. These fibers are mixed with cotton fibers. The resulting thread is water-repellent and maintains heat.

All of these documents can be considered as ones merely belonging to the technological field of the invention, in other words, they define a prior art concerning the same sector, but they do not anticipate the present invention, since none of the documents provide for the fiber added to the carrier thread having a strip-form shared by several parallel carrier threads, useable in itself, and/or from which final compound threads are extracted, resulting from the cutting of said strip. Neither do they include certain features existing in the present invention that will be described hereinafter.

DESCRIPTION OF THE INVENTION

In order to attain the objectives and to avoid the above cited inconveniences, the invention consists of some compound threads, as well as fabrics provided therefrom and to the processes to obtain them.

The invention makes it possible to make compound threads by making use of the short fibers, that would normally be disposed of, of the material used, permitting the obtainment of a more inexpensive and voluminous thread, very suitable to manufacture disposable fabrics.

In making threads according to the invention, a compact mass of fiber thread preferably coming from the carding of the same and that can contain long fibers as well as short fibers, is prepared.

This web mass is joined to a fine carrier thread in such a way that it remains adjacent and fixed to it, and in the same proportion all along the carrier thread, whereby the resulting thread remains in the condition to enter the loom for the warp, for the weft or for both together, to proceed to make the corresponding fabric.

The process for joining the web to the carrier thread is preferably done by using electrostatic means or using a water-soluble glue.

When water-soluble glue is used, the process consists of letting a certain amount of web coming from the carding drop by gravity on several carrier threads. A "shower" of water-soluble glue is then applied to the unit thus formed, after which it passes through some pressure rollers and then through a drying phase.

Hence, a strip or band of compact web is obtained which includes some parallel carrier threads and finally it is cut to separate each one of said parallel carrier threads, so that several threads are obtained according to the invention, each one of which includes a carrier thread and some adjacent areas of adhered web.

The obtained compound threads have a larger volume, for the same amount of fiber, than conventional threads, and without excess detriment of the mechanical resistance thereof due to the carrier thread that they include. This results in making the product cheaper and this is also increased upon making use of the short fibers which are disposed of in conventional processes.

On the other hand, the invention provides for making fabric at a very low cost, using the technique of reducing the number of weft and/or warp threads per surface unit, but preventing the resulting fabric from having holes between threads which are characteristic of conventional fabrics obtained by said technique.

Therefore, it is a question of filling some way these holes so that the fabric has continuity. By means of the invention, the holes are eliminated in the same manufacturing process of the fabric, which comes out of the loom already ready for use, only requiring the normal finishing processes. To avoid the holes between threads a mass that remains fastened mechanically between the weft and the warp of the fabric is used, without using any type of agglutinating agent.

This mass is that of the web itself of the fiber that is used for the fabric and that can be obtained by carding of said fiber or by another similar process. The web-form fiber has a much larger volume in detriment to the resistance and cohesion of the same, and with regard to the same amount of fiber in thread form.

The fabric is comprised of parallel weft threads and by warp threads which are also parallel but perpendicular to the weft threads crossed with them.

In order to obtain the fabric of the invention, prior to the passing of the thread, the thread is impregnated by electrostatic means or by any other method, with the above cited web, pulling said web in such a way that when weaving it remains next to the weft and/or warp thread, the unit having a much larger volume than if it did not have said web, this unit remaining fastened between the weft and warp threads in a crossed manner.

Hence, the holes, which in other conditions would remain between the warp threads and the weft threads, are non-existent in the fabric of the invention due to the fact that the corresponding spaces remain filled, in the weaving operation itself, by the web incorporated to the weft and/or warp thread. The covering corresponding to this filling of spaces is confirmed and consolidated in the subsequent convention finishing process of the fabric, especially in pressing or calendering the same.

The resulting fabric may be of various types depending on whether the web is incorporated in all of the passings (these passes being the weft ones, the warp ones or both), alternately, in one and then the next two without any; or any other combinations of presence-lack of web in the different passings of the thread, according to the desired characteristics, since a larger amount of web makes it easier to obtain fabrics with a greater absorption power, while a smaller amount of web makes it easier to obtain fabrics with greater mechanical resistance.

The improvements of fabrics of the invention can be carried out on natural threads, of animal or plant origin, on synthetic threads, on combinations of both or with any other type of thread.

The garments that are made with the fabric of the invention will preferably be table or bed linens, with very low cost due to the few threads per square centimeter that they have, though they will not be able to be subjected to hardly any aggressive washing process, since the web included would be easily carried away, which is not an inconvenience since said fabric has been foreseen for single use.

It should also be indicated that the improved fabric of the invention is totally and perfectly recyclable, thus meeting the maximum ecological requirements.

Hereinafter, to provide a better understanding of this specification and forming an integral part thereof, some figures in which the invention has been represented in an illustrative and on-restictive manner are attached.

DESCRIPTION OF SOME EMBODIMENTS OF THE INVENTION

Hereinafter a description of some embodiments of the invention is made, making reference to the numbering used in the figures.

Hence, one of these examples, shows a compound thread (1) obtained by a process in which a water-soluble glue is used.

The resulting compound thread (1) includes a very thin carrier thread (2) that remains adhered adjacently to one thicker part formed by the web (3) of the fiber that is used.

In other embodiments, this web (3) can be connected to the carrier thread (2) using electrostatic means or any other system, but the present embodiment is done in such a way that the fibrils coming from carding are left to drop by gravity and they constitute the web (3), upon a unit of fine carrier threads (2) placed parallel.

Then, a water-soluble glue is applied to the unit of fibrils and threads (2) by means of a "shower" so that no dispersions nor irregularities are produced in the distribution of the material that the glue receives.

Once the glue has been incorporated the unit is made to pass through some pressing rollers to that it remains compact enough.

Figure 1:
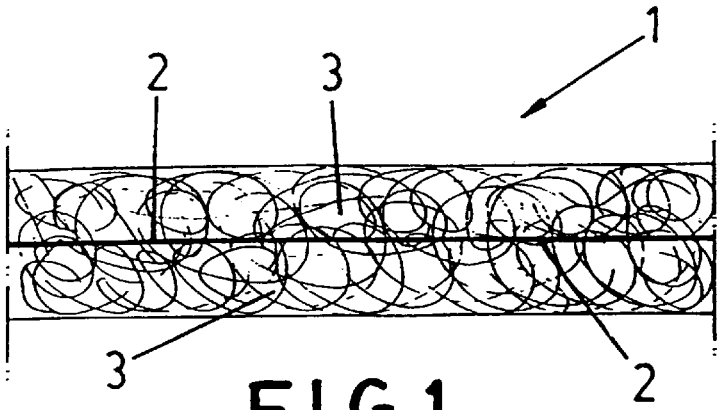
FIG. 1 represents a view of a piece of compound thread according to the present invention which includes a fine carrier thread and one part of adhered web.
Figure 2:
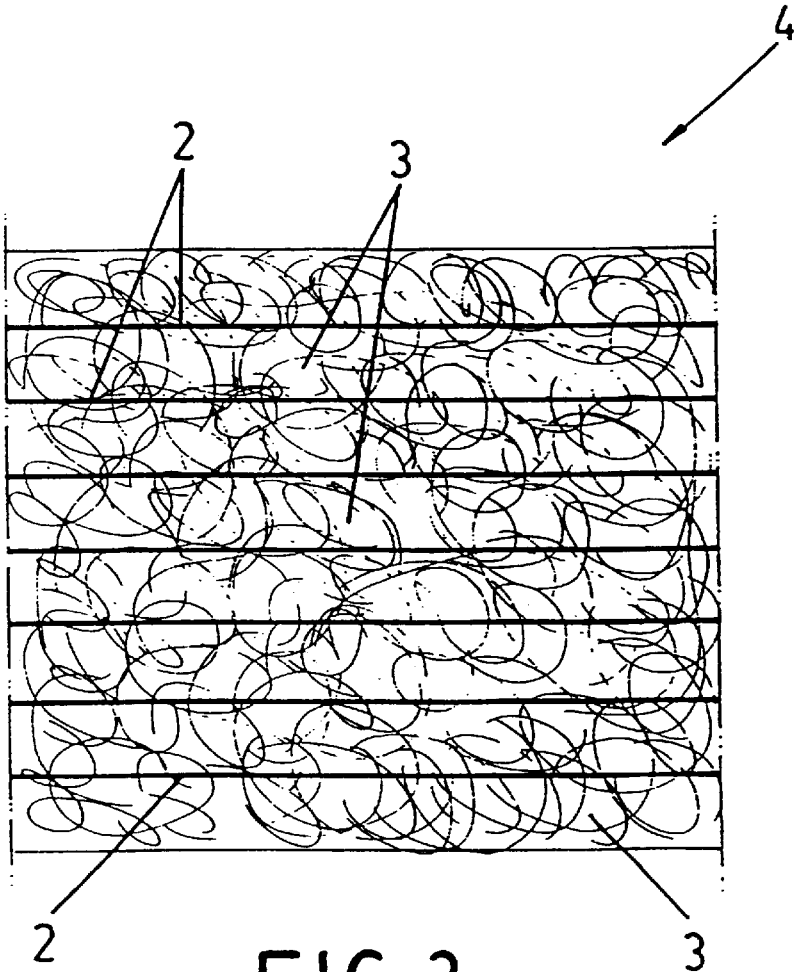
FIG. 2 represents a plan view of a piece of band or strip from which and by means of the cutting thereof improved threads according to the present invention are obtained.

After a drying phase, subsequent to the passing through the rollers, a band or strip (4) represented in FIG. 2 and formed by an extensive layer of web (3) adhered to a plurality of carrier threads (2) is obtained.

Finally, longitudinal cuts between every two of said carrier threads (2) are made, obtaining the improved thread (1) shown in the first figure of this specification.

Another example of this section shows a fabric (5) according to the invention, that includes some warp threads (6) and some thinner weft threads (7) crossed with the warp threads (6) in such a way that the crosses per surface unit constitute a small number compared to the number corresponding to conventional fabric, whereby fabric (5) is much less expensive.

In order to fill the holes (8) between the threads (6) and (7), a mass (9) comprised of the web of the fiber itself used to make threads (6) and (7) is used, obtaining this web by carding the fiber or by any other process, so that the mass (9) is less resistant to mechanical stress than threads (6) and (7), but its volume is much greater for the same amount of fibers, this mass (9) having an appearance similar to that of sanitary cotton.

Figure 3:
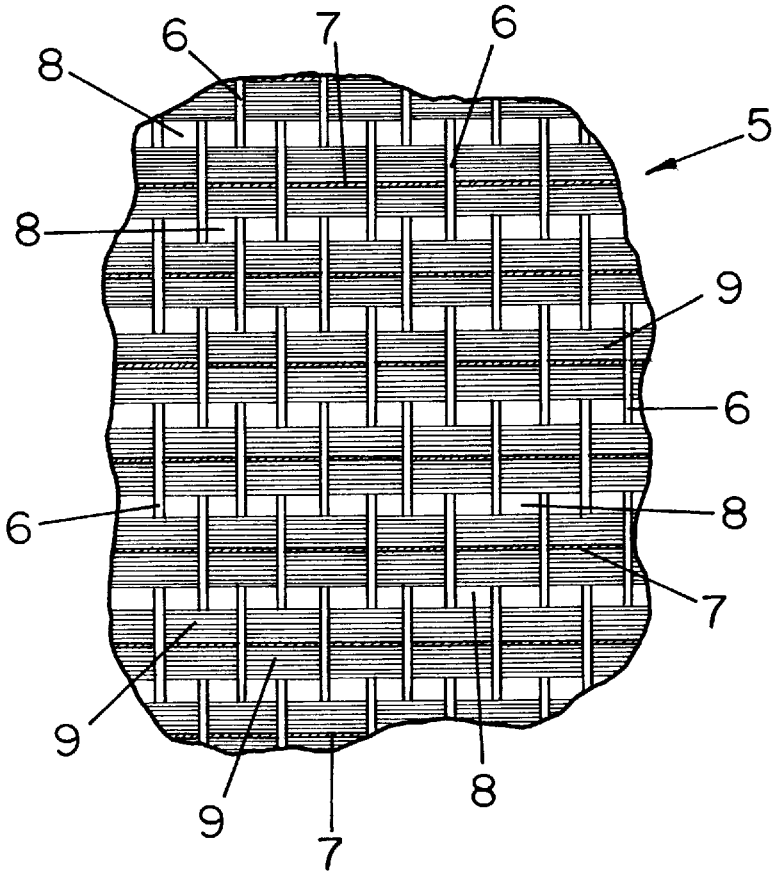
FIG. 3 represents a schematic plan view of a piece of fabric according to the invention, having included a separation (that does not really have to exist) between the different web sections, to show more clearly the structure and way of making said fabric. The example represented in this FIG. 3 includes web in all of the weft passings and in none of the warp ones, one of them being the simple and most useful shapes of the ones made possible by the invention.

Mass (9) is included parallel to the weft threads (7) and crossed with the warp threads (6), in such a way that the different sections of mass (9) remain adjacent to each other, whereby the holes (8) are non-existent, though in FIG. 3 a certain separation between these sections has been represented, for greater clarity of the same and so as to be able to show the holes (8).

Inclusion of the mass (9) is done during the weaving process itself. Hence, prior to the weft passing the thread (7) is impregnated with the mass (9), electrostatically or by means of another system, the unit being able to be formed by thread (7) and by the impregnated mass (9), just like compound thread (1) described in the previous example. Thus, the weft thread (7) will carry away the mass (9) in the weaving operation, remaining next to it as a constituent part of the weft, and the fabric (5) of the invention remaining formed, for want only of the finishing processes, similar to those that are carried out on conventional fabrics and that facilitate the consolidation of the formed structure.

In the present embodiment mass (9) has been incorporated in all of the weft passings, but in general other embodiments can be obtained eliminating it in some of them. Other embodiments can also be obtained by including the mass (9) in all or some of the warp passings, aside from or in substitution of that which is put in the weft ones, favoring the characteristics of absorption or resistance, depending on whether a larger or smaller amount of mass (9) is included.

We claim:

1. A fabric especially useful in the manufacture of garments and cloths, mainly disposable ones, comprising mutually parallel warp threads and mutually parallel weft threads, the warp threads being perpendicular to the weft threads, at least some of said warp threads and said weft threads being made of first fibers, the fabric comprising first threads inserted between second threads, the second threads extending perpendicularly to the first threads, the first threads being the warp threads and the second threads being the weft threads or the first threads being the weft threads and the second threads being the warp threads, there being holes left in the fabric between the warp threads and weft threads;

wherein, a mass of second fibers has been added to at least some of the first threads, said mass of second fibers being incorporated in the fabric, said mass filling up at least a substantial part of the holes left in the fabric; and wherein the mass of second fibers comprises left-over fibers produced when carding a fiber material, said second fibers having a shorter length than said first fibers.

2. A fabric according to claim 1, wherein the first threads are the warp threads and the second threads are the weft threads.

3. A fabric according to claim 1, wherein the first threads are the weft threads and the second threads are the warp threads.

4. A fabric according to claim 3, wherein the second fibers and the first fibers are of the same material, said material being a fiber material.

5. Fabric according to claim 4, wherein left-over fibers of the mass of second fibers are left-over fibers produced when carding said fiber material to obtain said first fibers.

6. A fabric according to claim 1, wherein the second fibers and the first fibers are of the same material, said material being a fiber material.

7. Fabric according to claim 6, wherein the left-over fibers of the mass of second fibers are left-over fibers produced when carding said fiber material to obtain said first fibers.

8. A fabric according to claim 2, wherein the second fibers and the first fibers are of the same material, said material being a fiber material.

9. A fabric according to claim 8, wherein the left-over fibers of the mass of second fibers are left-over fibers produced when carding said fiber material to obtain said first fibers.

10. Fabric according to claim 1, wherein the second fibers are adhered to the first threads by electrostatic means.

11. Fabric according to claim 2, wherein the second fibers are adhered to the first threads by electrostatic means.

12. Fabric according to claim 3, wherein the second fibers are adhered to the first threads by electrostatic means.

13. Fabric according to claim 4, wherein the second fibers are adhered to the first threads by electrostatic means.

14. Fabric according to claim 5, wherein the second fibers are adhered to the first threads by electrostatic means.

* * * * *